US005286917A

United States Patent [19]

Unno et al.

[11] Patent Number: 5,286,917

[45] Date of Patent: Feb. 15, 1994

[54] APPARATUS FOR DEVELOPING ELECTROSTATIC LATENT IMAGE AND DEVELOPING ROLLER THEREFOR

[75] Inventors: Akira Unno, Yokohama; Hiroto Hasegawa, Kawasaki; Fumihiro Arahira, Ninomiya, all of Japan

[73] Assignee: Canon Kabushiki Kaisha, Tokyo, Japan

[21] Appl. No.: 765,983

[22] Filed: Sep. 26, 1991

[30] Foreign Application Priority Data

Sep. 28, 1990 [JP] Japan ..... 2-260017

[51] Int. Cl.[5] ..... G03G 15/09

[52] U.S. Cl. ..... 118/651; 118/657; 355/245; 355/251

[58] Field of Search ..... 118/647, 651, 657, 658; 355/245, 251, 253, 259, 261

[56] References Cited

U.S. PATENT DOCUMENTS

| | | | |
|---|---|---|---|
| 4,292,387 | 9/1981 | Kanbe et al. | 430/102 |
| 4,368,971 | 1/1983 | Watanabe et al. | 118/658 X |
| 4,377,332 | 3/1983 | Tamura | 118/658 X |
| 4,380,966 | 4/1983 | Isaka et al. | 118/651 |
| 4,522,866 | 6/1985 | Nishikawa et al. | 428/216 |
| 4,982,689 | 1/1991 | Honda et al. | 355/251 X |
| 4,989,044 | 1/1991 | Nishimura et al. | 355/251 |

FOREIGN PATENT DOCUMENTS

| | | |
|---|---|---|
| 0060030 | 9/1982 | European Pat. Off. . |
| 0339944 | 11/1989 | European Pat. Off. . |
| 3247537 | 7/1983 | Fed. Rep. of Germany . |
| 6052879 | 9/1983 | Japan . |
| 61112174 | 11/1984 | Japan . |
| 0018580 | 1/1990 | Japan . |
| 0091672 | 3/1990 | Japan . |
| 01-05181 | 4/1990 | Japan . |
| 01-09072 | 4/1990 | Japan . |
| 0306274 | 12/1990 | Japan . |
| 2088252 | 6/1982 | United Kingdom . |

OTHER PUBLICATIONS

Japanese Standards Association, Definitions and Designation of Surface Roughness, Japanese Industrial Standard, JIS B 0601, published 1982, p. 112.

*Primary Examiner*—Benjamin R. Fuller
*Assistant Examiner*—J. E. Barlow, Jr.
*Attorney, Agent, or Firm*—Fitzpatrick, Cella, Harper & Scinto

[57] ABSTRACT

A developing apparatus for developing an electrostatic latent image having a movable developer carrying member for carrying one component developer to a developing zone where the developer carrying member is opposed to a latent image bearing member for carrying the electrostatic latent image, the developer carrying member being effective to triboelectrically charge the developer to a polarity for developing the latent image; a regulating member for regulating a thickness of a layer of the developer to be carried to the developing zone; a voltage source for applying a developing bias voltage to the developer carrying member; wherein the developer carrying member has a base member having a surface sandblasted to have an average surface roughness of 1.0–3.0 microns, and an outer layer thereon in which fine graphite particles are dispersed in a binder resin material, and wherein the outer layer has an average surface roughness of 0.8–2.5 microns.

38 Claims, 3 Drawing Sheets

APPARATUS FOR DEVELOPING ELECTROSTATIC LATENT IMAGE AND DEVELOPING ROLLER THEREFOR

FIELD OF THE INVENTION AND RELATED ART

The present invention relates to a developing apparatus for developing electrostatic latent images, and more particularly, to a developer carrying member therefor.

A developing apparatus using one component developer is widely used in electrophotographic coping machines and printers.

U.S. Pat. Nos. 4,377,322 and 4,380,966 disclose that the surface of a developer carrying member is roughened to improve the developer conveying performance.

In the developing apparatus used with a one component developer, the toner particles are triboelectrically charged by contact with the developer carrying member to a polarity suitable to develop the latent image. The roughened developer carrying member is effective to charge the toner particles to a proper degree.

In such a region of the developer carrying member as corresponds to the non-image area of an image bearing member, the developer is not consumed. If the non-consuming situation continues, fine developer is strongly attached probably due to mirror force with the results that the developer is not easily consumed even when the area subsequently corresponds to an image area, and that the amount of charge decreases. If this occurs, a ghost image is formed.

FIG. 6 explains this more in detail. The density difference occurs between a portion (a) (white continued) and a portion (b) (black continued). The ghost image formation mechanism is significantly concerned with a fine particle layer formed on the developer carrying member. The particle size distribution of the bottom part of the developer layer is remarkably different depending on whether the toner is consumed or not. The fine particle layer is formed particularly in the non-consumed toner areas. Since a fine particle has a large surface area per unit volume, it has larger amount of triboelectric charge per unit weight than a larger size particle. Therefore, the smaller size particles are more strongly deposited on the developer carrying member by the mirror force. The toner particles on the fine particle layer are not triboelectrically charged to a sufficient extent, with the result of degraded developing performance, and therefore, ghost image production.

The recent demand for high image quality in electrophotographic apparatus requires that the toner size is reduced. In the case of an electrophotographic laser beam printer, if the print density is increased from 300 dpi from 600 dpi (23.6 pel), the desired resolution, sharpness and therefore faithful development of an electrostatic latent image is relatively easily achieved if a toner having a particle size of 9–4 microns is used. An example of such toner has a volume average particle size of 6.0 microns, and the particle size distribution on the basis of number is approx. 20% or smaller for no greater than 3.5 microns of the volume average particle size, and the particle size distribution on the basis of the volume is approx. 10% or smaller for no less than 16 microns of the volume average particle size.

However, such toner particles have larger surface areas per unit volume, and therefore, the amount of the triboelectric charge is larger per unit volume and weight. In addition, the resin content in the toner increases. For these reasons, the surface of the developer carrying member is more easily contaminated by a toner having a high triboelectric charge. This promotes ghost image.

U.S. Pat. No, 4,989,044 and EPA-0,339,944 disclose a developer carrying member provided with a surface layer comprising carbon black fine particles and fine graphite particles dispersed in a resin binder.

This is effective to prevent the ghost image. However, the surface layer is relatively easily peeled off in parts, with long term use. The surface layer is worn with the result of poor charging and conveying performance, and therefore, non-uniform toner layer formation. Improvement in this respect is desired and, in addition, improvement is desired in the easy production of the desired surface roughness.

SUMMARY OF THE INVENTION

Accordingly, it is a principal object of the present invention to provide a developing apparatus wherein fine developer particles are prevented from strongly attaching to the developer carrying member, so that good developed images are provided.

It is another object of the present invention to provide a developing apparatus wherein the triboelectric charging power and the conveying power can be maintained in long term use, so that the developer carrying member can form a uniform developer layer in long term use.

According to an aspect of the present invention, the developer carrying member has a base member having a sand-blasted roughened surface having surface roughness of 1.0–3.0 microns (Ra) and an outer layer applied thereon, comprising a binder resin and fine graphite particles dispersed therein, wherein the average surface roughness is 0.8–2.5 microns (Ra). Since the outer layer is applied on the roughened surface, it is strongly attached to the base, and therefore, not easily peeled off the base, and change in the surface roughness of the outer layer can be suppressed. In addition, it is easy to provide a desired surface roughness.

According to another aspect of the present invention, the surface of such a base member is coated with another binder resin comprising fine particles dispersed therein. The outer layer is further prevented from peeling off, and in the surface roughness of the surface can be suppressed.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
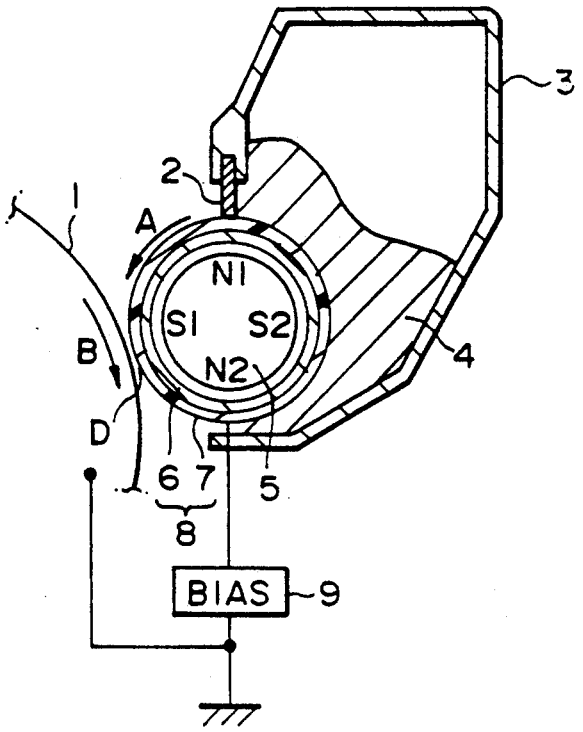
FIG. 1 is a sectional view of a developing apparatus according to an embodiment of the present invention.

FIG. 1 is a sectional view of a developing apparatus according to an embodiment of the present invention. The developing apparatus uses a one component magnetic developer to develop an electrostatic latent image on an image bearing member.

First, the description will be made as to the one component magnetic developer.

Binder resin of a one component magnetic developer used with the embodiments of the present invention may be the following or a mixture of the following polymer of styrene and substitute thereof such as polystyrene and polyvinyltoluene; styrene copolymer such as styrene-propylene copolymer, styrene-vinyltoluene copolymer, styrene-vinylnaphthalene copolymer, styrene-acrylic acid methyl copolymer, styrene-acrylic acid ethyl copolymer, styrene-acrylic acid butyl copolymer, styrene-acrylic acid octyl copolymer, styrene-acrylic acid dimethylaminoethyl copolymer, styrene-methacrylic acid methyl copolymer, styrene-methacrylic acid ethyl copolymer, styrene-methacrylic acid butyl copolymer, styrene-methacrylate dimethylaminoethyl copolymer, styrene-vinylmethylether copolymer, styrene-vinylethylether copolymer, styrene-vinylmethylketone copolymer, styrene-butadiene copolymer, styrene-isoprene copolymer, styrene-maleic acid, styrene-maleic acid ester copolymer; polymethylmethacrylate, polybutylmethacrylate, polyvinylacetate, polyethylene, polypropylene, polyvinylbutyral, polyacrylic acid resin, rosin, modified rosin, turpentine resin, phenolic resin aliphatic hydrocarbon resin, alicyclic hydrocarbon resin, aromatic petroleum resin, paraffin wax, carnauba wax.

As for the coloring material added to the magnetic toner, they may be known carbon black, copper phthalocyanine, iron black or the like.

The magnetic fine particles contained in the magnetic toner may be of the material magnetizable when placed in a magnetic field, such a ferromagnetic powder of a metal such as iron, cobalt and nickel, a powder of a metal alloy or a powder of a compound such as magnetite, $\gamma$-$Fe_2O_3$ and ferrite.

The fine magnetic particle preferably has BET specific surface area, obtained by a nitrogen absorbing method of 1-20 $m^2/g$, more particularly 2.5-12 $m^2/g$, and a Moh's hardness of 5-7. The content of the magnetic particles is 10-70% by weight on the basis of the weight of the toner.

The toner may contain, as desired, a charge controlling agent, more particularly a negative charge controlling agent such as metallic complex salt of monoazo dye salicylic acid, alkyl salicylic acid, dialkyl salicylic acid or naphthoric acid or the like. Volume resistivity of the toner is preferably not less than $10^{10}$ ohm.cm, further preferably not less than $10^{12}$ ohm.cm from the standpoint of the triboelectric charge retention and the electrostatic image transfer. The volume resistivity here is defined as a value obtained in this method. The toner is caked with a pressure of 100 $kg/cm^2$, and an electric field of $10^0$V/cm is applied, and then the current is measured after one minute from the electric field application. The resistivity is obtained from the current and the electric field, and is defined as the volume resistivity.

The amount of triboelectric charge of the negatively chargeable toner is preferably $-8$ $\mu C/g$ to $-20$ $\mu C/g$. If it is less than $-8$ $\mu C/g$, the image density is low, particularly under the high humidity conditions. If, on the other hand, it exceeds $-20$ $\mu C/g$, the charge of the toner is too high with the result of thin line images, so that the image is poor, particularly under low humidity conditions.

The negatively chargeable toner particles are defined in this manner. Under the conditions of 25° C. temperature and 50-60% relative humidity, 10 g of toner particles are left at rest one night. They are mixed with 90 g of carrier iron powder (for example, EFV 200/300 available from Nihon Teppun Kabushiki Kaisha, Japan) without resin coating and having a major particle size of 200-300 mesh under the above conditions, in an aluminum pot having a volume of 200 $cm^3$. It is then shaked vertically by hand approximately 50 times. Then, the triboelectric charge amount of the toner particles is measured by a normal blow-off method using an aluminum cell having a 400 mesh screen. If the triboelectric charge produced by this method is negative, the toner particles are negatively chargeable toner particles.

As for the fine silica particles used for the purpose of increasing the fluidity of the developer, they may be dry silica produced from a silica halogen compound by vapor phase oxidation, a dry silica called "fumed silica" or a "wet silica" produced from a water-glass or the like. However, the dry silica is preferable since the surface and inside thereof contain less silanol group and less residual materials. During the production of the dry silica, metallic halide such as aluminum chloride and titanium chloride together with the silica halide may be used, by which compound fine powder of silica and other metal oxide can be produced. The dry silica includes such material.

The fine silica particle has preferably been treated to acquire, hydrophobic nature. The method for this treatment may be one of known methods. For example, by chemical treatment with an organic silica compound reactable with, or physically attachable with fine silica particles, the hydrophobic nature is given. As a preferable method, fine silica particles produced by vapor phase oxidation of the silica halide are treated with a silane coupling agent, and thereafter or simultaneously therewith, it is treated with an organic silica compound.

The degree of the hydrophobic nature of the finally treated fine silica particles is 30-80 as a preferable range, since then triboelectric charge distribution of the developer containing such fine silica particles provides discrete and uniform negative electric property. Here, the degree of the hydrophobic nature is measured by titration test with methanol.

The methanol titration test is to determine the degree of the hydrophobic nature of the silica fine particles having surfaces of hydrophobic nature.

The methanol titration test is performed in this manner. In water (50 ml) in a conical flask having a capacity of 250 ml, 0.2 g of silica fine particles to be tested is added. Methanol is dropped from buret until all of the silica particles are wet. During this time, the liquid in the flask is always stirred when a magnetic stirrer. The end is determined by all of the silica particles becoming are in a suspended state. The degree of the hydrophobicity is expressed as a percentage of the methanol in the mixture of the methanol and the water.

The amount of the silica fine particles to the toner is preferably 0.05–3 parts by weight based on by weight of the toner (100 parts), further preferably, it is 0.1–2 parts by weight, since then the developer exhibits stabilized charging property. It is preferable that 0.01–1 part, by weight based on the weight of the developer, of the silica fine particles are deposited on the surface of the toner particle.

The developer may contain, as long as no adverse affect is given, another or other materials, for example, a lubricant such as tetrafluoroethylene resin and zinc stearate, an agent for assisting image fixing (for example, low-molecular-weight polyethylene resin) or an agent for providing electric conductivity such as metal oxide such as tin oxide, or the like.

As for the method of producing the toner, the constituting materials are kneaded by a heat-kneader such as a heated roll, extruder or other kneader. Then, the product is mechanically pulverized and classified. Alternatively, the materials are dispersed in binder resin liquid, and then it is sprayed and dried. Further alternatively, the desired materials are mixed into the monomeric material constituting the binder resin, and then it is emulsified, and thereafter, polymerized.

The description will now be made as to the embodiment of the developing apparatus.

Referring to FIG. 1, an image bearing member, that is, an electrophotographic photosensitive drum 1 having an electrostatic latent image formed through a known process, in this embodiment, rotates in the direction indicated by an arrow B. A developer carrying member, that is, a developing sleeve 8 in this embodiment, carries a one component magnetic developer 4 supplied from the hopper 3, and rotates in the direction A to carry the developer into a developing zone D where the sleeve 8 and the drum 1 are opposed to each other. In order to magnetically attract and retain the developer on the sleeve 8, a magnet 5 is disposed in the sleeve 8.

In order to regulate the thickness of the layer of the developer conveyed to the developing zone D, a regulating blade 2 made of a ferromagnetic metal is opposed to the developing sleeve 8 surface with a gap of 200–300 microns. By concentration of magnetic lines of force from a magnetic pole N1 of the magnet 5 onto the blade 2, a thin layer of the magnetic developer is formed on the sleeve 2. In place of the magnetic blade 2, a non-magnetic blade is usable.

The thickness of the thin developer layer formed on the sleeve 8 is preferably smaller than the minimum clearance between the sleeve 8 and the drum 1 in the developing zone D. The present invention is particularly effective when used with the above-described type developing device, that is, a non-contact type developing device wherein the layer of the developer has such a thickness. However, the present invention is also applicable to a contact-type developing device wherein the thickness of the developer in the developing zone is larger than the clearance between the sleeve 8 and the drum 1. The following descriptions will be made with respect to the non-contact type developing device for simplicity.

The sleeve 8 is supplied with a developing bias voltage from the voltage source 9 so as to transfer the developer from the developer layer carried on the sleeve to the drum 1. If a DC voltage is used for this bias voltage, the voltage applied to the sleeve 8 is preferably between the potential of the image area of the latent image (the area to which the developer is to be deposited, and therefore, to be visualized) and the potential of the background area. In order to increase the image density of the developed image or in order to improve the tone reproducibility, an alternating bias voltage may be applied to the sleeve 8 to form a vibrating electric field in the developing zone D. In this case, it is preferable that the alternating voltage is provided by superimposing an AC voltage with a DC voltage having a level between the image portion potential and the background potential (U.S. Pat. No. 4,292,387). In a regular development wherein the toner is deposited to a high potential portion of the latent image constituted by the high potential portion and a low potential portion, the toner used is chargeable to a polarity opposite to the polarity of the latent image, whereas in a reverse-development wherein the toner is deposited to the low potential area of the latent image, the toner used is chargeable to the polarity which is the same as the polarity of the latent image. Here, the high potential and low potential is are determined on the basis of an absolute value of the potential. In any event, the toner is electrically charged by friction with the sleeve 8 to polarity for developing the latent image. The added fine silica particles are also electrically charged by the friction with the sleeve 8.

Figure 2:
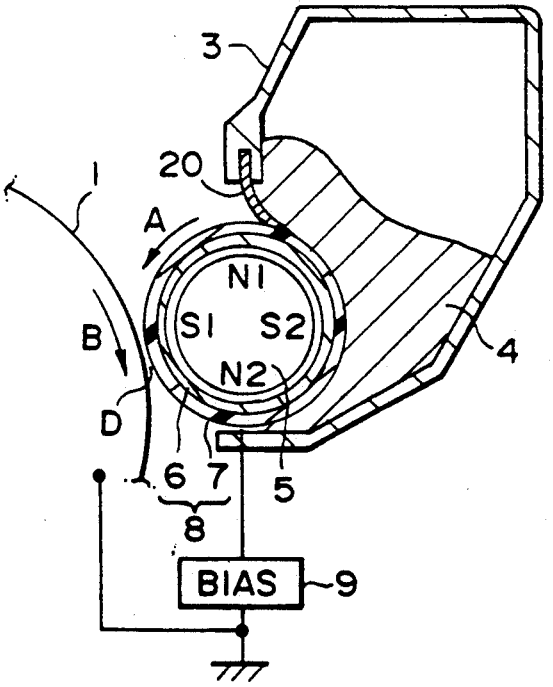
FIG. 2 is a sectional view of a developing apparatus according to another embodiment of the present invention.
Figure 3:
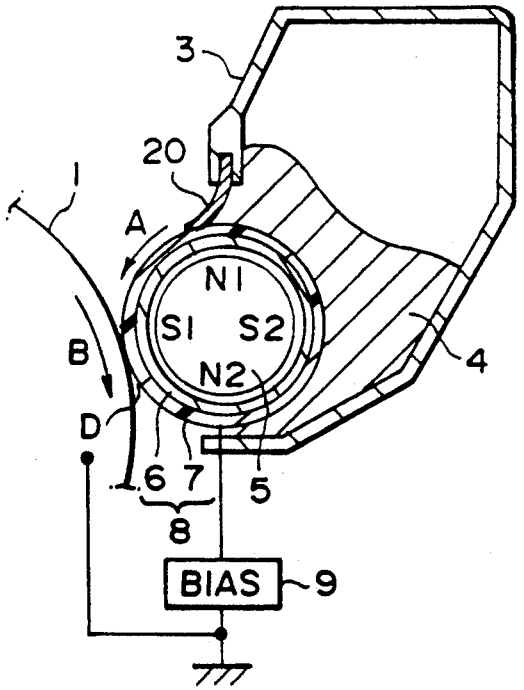
FIG. 3 is a sectional view of a developing apparatus according to a further embodiment of the present invention.

FIG. 2 shows a developing apparatus according to another embodiment of the present invention, and FIG. 3 shows a further embodiment of the present invention.

In FIGS. 2 and 3, developing apparatus comprises a member for regulating the magnetic toner 4 layer thickness on the developing sleeve 8. The regulating member is of a rubber elastic material such as urethane rubber, silicone rubber or the like or an elastic metal such as phosphor bronze, stainless steel or the like. The member is in the form of an elastic plate 20 which is press-contacted counterdirectionally to the developing sleeve 8 with respect to movement direction of the sleeve surface in FIG. 2, and codirectionally in FIG. 3. With such a structure, the produced toner layer is further thinner. The other structures of the developing apparatus of FIG. 2 and FIG. 3 are the same as those of the FIG. 1 apparatus, and therefore, the detailed description thereof is omitted by assigning the same reference numerals as in FIG. 1 to the element having the corresponding functions.

The developing apparatus of FIGS. 2 and 3 wherein the toner layer is formed on the developing sleeve 8 is suitable for use with a one component magnetic developer mainly comprising magnetic toner and a one component magnetic developer mainly comprising non-magnetic toner. In either case, the toner is rubbed between the elastic plate 20 and developing sleeve 8, and the toner is sufficiently charged, so that the image quality is improved. This is preferable under high humidity conditions tending to decrease the triboelectric charge.

In this embodiment, the developing sleeve 8 (roller) has a base member 6 comprising a roughened surface having fine pits and projections and has a resin coating 7 in which at least graphite particles are dispersed. The magnetic toner 4 is triboelectrically charged by the resin coating 7 to a polarity suitable to develop the electrostatic latent image. The fine graphite particles are exposed on the resin coating 7. The fine graphite particles are effective to leak the overcharge of the toner, and exhibit good solid lubricating effects so that they are effective to decrease the deposition force of the fine toner particles onto the developing sleeve 8.

The base member 6 may be of aluminum, stainless steel, brass or the like roughened by sand blasting. It may be a metal cylinder 6' made of aluminum, stainless steel, brass or the like coated with an intermediate layer 6'' comprising a material different from graphite, preferably hard inorganic fine particles which are dispersed in a resin material different from the resin material of the resin coating 7, and most preferably a material exhibiting stronger binding force to the cylinder than the binder resin material of the resin coating 7.

Figure 4:
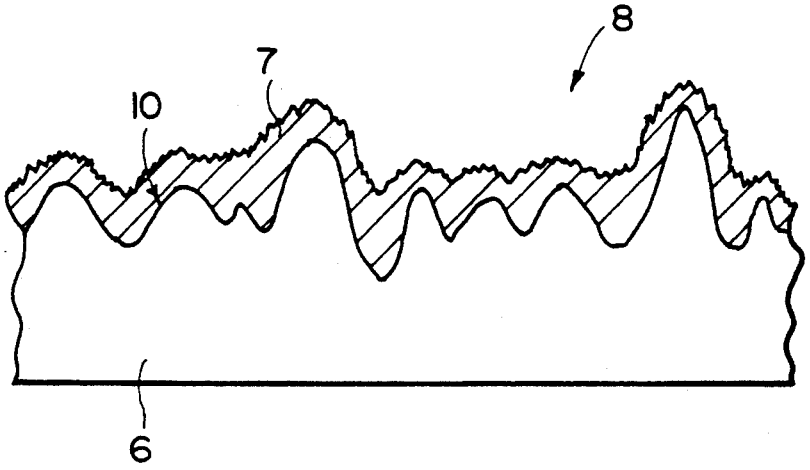
FIG. 4 is an enlarged partial sectional view of a developer carrying member according to an embodiment of the present invention.
Figure 5:
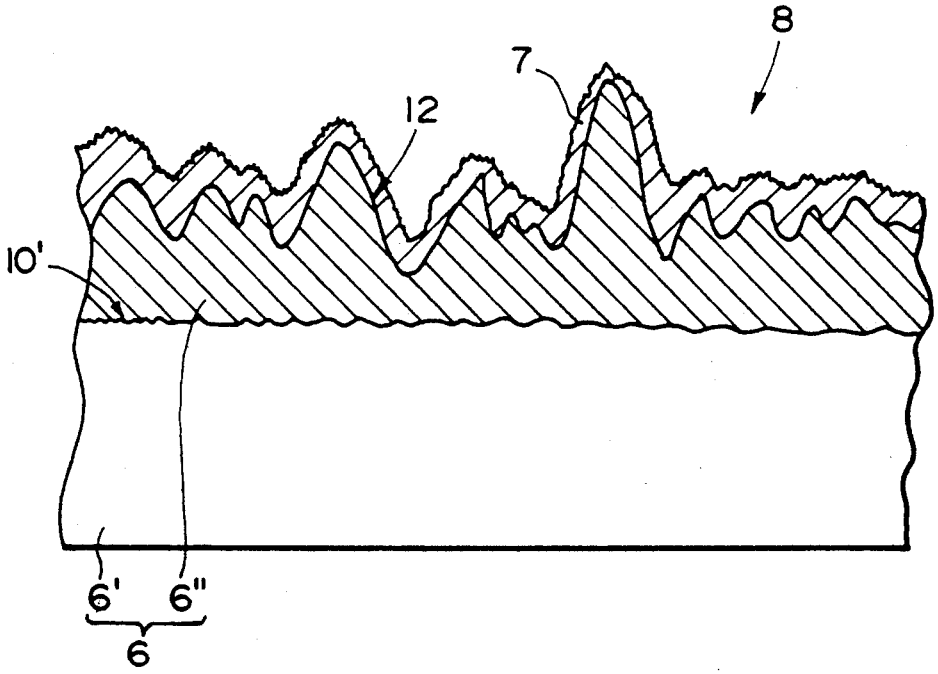
FIG. 5 is an enlarged partial sectional view of a developer carrying member according to another embodiment of the present invention.
Figure 6:
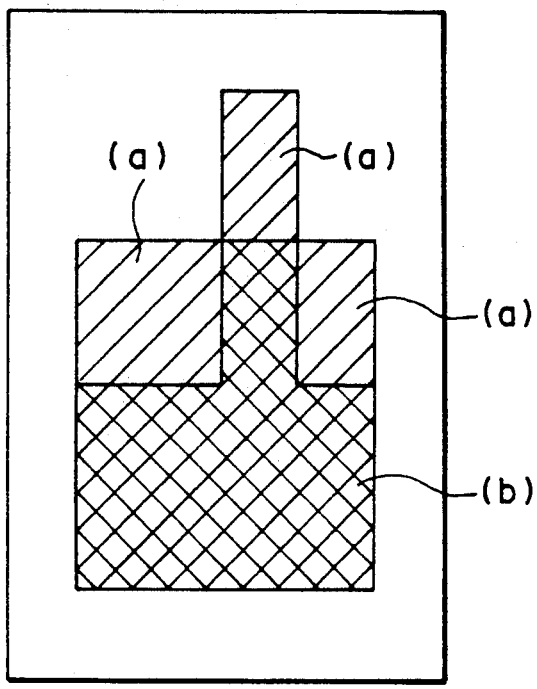
FIG. 6 PRIOR ART
FIG. 6 illustrates a ghost image (Prior Art).

FIG. 4 shows a part of the developing sleeve 8 comprising former base member 6, and FIG. 5 shows developing sleeve 8 comprising the latter base member 6. These embodiment will be described.

Embodiment 1

As shown in FIG. 4, the surface of the base member 6 is sand-blasted with irregular abrading particles (the shape of the particles is irregular, and has plural sharp edges) to provide roughened surface 10. The resin coating 7 is formed on the roughened surface. Referring to Table 1, developing sleeves No. 2–4 were produced according to the embodiment of the present invention. For comparison, sleeve No. 1 was produced without sandblasting the surface.

The base member 6 was made of a drawn aluminum alloy (3003), and was sandblasted with alundum particles. The blasting machine used was conventional air jet type (Newma blaster, available from Fuji Seisakusho, Japan). The blasting period was 60 sec, and the base member 6 was rotated at 20 rpm.

Table 1 below shows the blasting conditions and the average surface roughness (Ra) for base members Nos. 1–4.

TABLE 1

| | SLEEVE Nos. | | | |
|---|---|---|---|---|
| | 1 | 2 | 3 | 4 |
| BLASTING PARTICLES | NON | #200 | #100 | #100 |
| AIR PRESSURE ($kg/cm^2$) | | 2 | 2 | 4 |
| SURFACE ROUGHNESS (Ra)(microns) | 0.5 | 1.0 | 2.0 | 3.0 |

The average surface roughness (Ra) is expressed as a center line average roughness defined in JIS B-0601 (microns).

The resin coating 7 was made of resin materials given in Table 2, comprising graphite particles and carbon black particles. They were dispersed in a paint shaker with glass beads for 3 hours into a form of paint. The solid content of the paint was adjusted to be 25%, and was applied to the surface of the base member 6 to provide the resin coating 7.

TABLE 2

| BINDER RESINS | GRAPHITE | GRAPHITE | SOLVENT |
|---|---|---|---|
| PHENOL | AVE. SIZE 7 MICRONS | AVE. SIZE 0.2 MICRON | IPA (ISOPROPYL) ALCOHOL) |
| 20 PARTS BY WT. | 9 PARTS | 1 PARTS | 20 PARTS |

Table 3 shows weight applied on the resin coating 7 and the average surface roughness (Ra) for each of the sleeves Nos. 1–4. It is given as roughness (after) together with the surface roughness (before) given in Table 1.

TABLE 3

| | SLEEVE Nos. | | | |
|---|---|---|---|---|
| | 1 | 2 | 3 | 4 |
| ROUGHNESS (BEFORE) MICRONS | 0.5 | 1.0 | 2.0 | 3.0 |
| WEIGHT APPLIED ($G/M^2$) | 8.0 | 8.0 | 8.0 | 8.0 |
| ROUGHNESS (AFTER) MICRONS | 0.6 | 1.2 | 1.8 | 2.4 |

The developing sleeves Nos. 1–4 were incorporated in the developing apparatus and, image forming operations were performed.

The used image forming apparatus was a laser beam printer LBP-SX (available from Canon Kabushiki Kaisha, Japan). Image forming operations were continued for 5000 sheets under normal temperature and humidity conditions. Table 4 below shows the results:

TABLE 4

| | SLEEVE Nos. | | | |
|---|---|---|---|---|
| | 1 | 2 | 3 | 4 |
| IMAGE DENSITY | NG | G | E | G |
| GHOST | F | G | E | G |
| DENSITY NON-UNIFORMITY | F | G | E | G |
| PEELING | NU | E | E | E |

E: Excellent
G: Good
F: Practically usable
NG: No good
NU: Non-usable.

The same results as in Table 4 were confirmed under low temperature and low humidity conditions and under high temperature and low humidity conditions (5000 sheets).

The results will be evaluated.

(a) Image Density

Only sleeve No. 1 showed low image density. Sleeves Nos. 2–4 have the base member 6 with properly roughened surface (Ra = 1.0–3.0), and therefore, the surface of the resin coating 7 thereon has proper roughness. Thus, the developer conveying force is strong to provide a sufficient toner layer. But, sleeve No. 1 does not have the above nature because the surface roughness is too small.

Table 5 shows a value of the sleeve surface Sm (average intervals between pits or projections of the resin surface) together with the surface roughness (before) given in Table 1.

TABLE 5

| | SLEEVE NOS. | | | |
|---|---|---|---|---|
| | 1 | 2 | 3 | 4 |
| SURFACE ROUGHNESS (BEFORE) | 0.5 | 1.0 | 2.0 | 3.0 |
| Sm (MICRONS) | 20 | 30 | 0 | 70 |

From the standpoint of the Sm value, in order to increase the toner coat quantity, it has been found that the proper Sm value is 30–70 on the developing sleeve. The average interval Sm is defined in ISO 4287/1-1984, Section 6.4.

(b) Ghosts and Uniformity of Image Density

Sleeves Nos. 1–4 are all practically good in terms of the ghost and uniformity of the image density. It has been found that Sleeve No. 3 is the best. This is because the coating layer functions to properly leak the charge of fine particles and to prevent the formation of the fine particle layer by the solid lubrication.

(c) Peeling of the Coat

In sleeve No. 1 the peeling was remarkable, but not in sleeves Nos. 2–4, because of the provision of a roughened surface on the surface of the base member 6 which is effective to improve the bonding between itself and coating layer 7.

In the foregoing, the base member 6 was made of aluminum, but a copper alloy, or stainless steel is usable. The surface roughness of the base member 6 is preferably 1.0–3.0, as described hereinbefore.

The surface roughness of the resin coating 7 on the roughened surface of the base member 6 was preferably 1.2–2.4 microns. The inventors have found that Ra=0-.8–2.5 microns is preferable.

Embodiment 2

As shown in FIG. 5, a surface of cylindrical base member 6' made of drawn aluminum which corresponds to the base member 6 of Table 1, was not blast-treated, and instead, resin layer 6'' comprising titanium oxide as filler material was applied with the following contents:

TABLE 6

| | SLEEVE NO. | | | |
|---|---|---|---|---|
| | 5 | 6 | 7 | 8 |
| BINDER RESIN (PARTS) | 100 | 100 | 100 | 100 |
| TITANIUM OXIDE (PARTS) | 100 | 100 | 200 | 200 |
| AVE. PART. SIZE (MICRON) | 20 | 30 | 20 | 30 |
| CARBON BLACK (PARTS) | 30 | 30 | 30 | 30 |
| AVE. PART. SIZE (M-MICRONS) | 50 | 10 | 10 | 10 |

(PARTS: BY WEIGHT)

In the surface of the resin layer 6'', the fine particle filler is dispersed in the resin, so that a finely rough surface 12 is provided. The weight of the application of the intermediate resin layer is 4.0 g/m$^2$ in sleeves Nos. 5–8.

On the rough surface 12, the resin paint of the composition of the following Table 7 was applied to provide the resin coating 7 as the developing sleeves Nos. 5–8.

TABLE 7

| BINDER RESINS | GRAPHITE | CARBON BLACK | SOLVENT |
|---|---|---|---|
| PHENOL 20 WT. PARTS | AVE. PART. SIZE 10 MICRONS 9 WT. PARTS | AVE. PART. SIZE 0.1 MICRONS 1 WT. PARTS | METHANOL 20 WT. PARTS |

Table 8 shows characteristic of Sleeves Nos. 5–8. The weight of the applied coating was 8.0 g/m$^2$ for all.

TABLE 8

| | SLEEVE NO. | | | |
|---|---|---|---|---|
| | 5 | 6 | 7 | 8 |
| SURFACE ROUGHNESS (INT. LAYER) Ra (MICRONS) | 0.6 | 1.0 | 1.7 | 2.5 |
| SURFACE ROUGHNESS (OUTER LAYER) (MICRONS) | 1.0 | 1.5 | 2.0 | 3.0 |
| OUTER LAYER Sm (MICRONS) | 40 | 50 | 60 | 70 |

Sleeves Nos. 5–8 were incorporated in the developing apparatus of the image forming apparatus as in Embodiment 1, and the image forming operation was carried out. The evaluation of the sleeves is as shown in Table 9.

TABLE 9

| | SLEEVE NO. | | | |
|---|---|---|---|---|
| | 5 | 6 | 7 | 8 |
| IMAGE DENSITY | G | G | E | G |
| GHOST | G | G | E | G |
| DENSITY UNIFORMITY | G | G | E | G |
| PEELING | G | G | E | G |

G: GOOD
E: EXCELLENT

In the case of resin coating 7 applied on the resin layer 6'', as will be understood from sleeve No. 8, good results are obtained even if the surface roughness is 3.0 microns (Ra). The reason for this is considered to be that the profile of the surface of the resin coating 7 is different in the FIG. 5 case than in the FIG. 4 case. It will be readily understood that sufficient toner conveyance and triboelectric charge when the surface roughness is 1.0–3.0 microns.

From the standpoint of Sm value, it is preferably 40–70 microns to provide good toner conveying power.

In FIG. 5, it is preferable that the bonding strength between the cylindrical base member 6' and the bonding resin (first resin) for the resin layer 6'' comprising fine particle filler (titanium oxide in Table 6) functioning as a primer for the developing sleeve, is higher than the bonding strength between the cylindrical base member 6' and the bonding resin (second resin) for the outer layer 7, since then the outer layer is not easily peeled off from the sleeve as compared with the case in which the outer layer is directly applied on the cylindrical base member 6'. Since the outer layer and the intermediate layer are made of resin materials, the bonding strength therebetween is high. Therefore, as compared with the case of FIG. 4, the outer layer 7 is more surely bonded to the sleeve even if the surface roughness (Ra) of the surface coated with the outer layer 7 is smaller.

Since the bonding strength to the cylindrical base member 6' is enhanced by the first resin constituting the resin layer 6'', the second resin constituting the outer layer 7 preferably has a hardness higher than the first resin. Then, wearing of the outer layer 7 is prevented.

In order to provide the outer layer 7 with the proper surface roughness Ra, the volume average particle size of the fine particle filler (titanium oxide in Table 6) dispersed in resin layer 6'' is preferably larger than the volume average particle size of the fine graphite particles dispersed in the outer layer 7.

Table 6, carbon black is added in the resin layer 6'' to decrease the electric resistance of the resin layer 6'' as compared with the case wherein only the fine particles filler is dispersed, whereby the overcharge on the toner from the outer layer can be easily leaked to the metal base 6', and in addition, the effect of the developing bias voltage is enhanced.

The surface roughness of the resin layer 6" is mainly provided by the fine particle filler such as titanium oxide, and therefore, the carbon black fine particles dispersed in the resin layer 6" preferably have a smaller average particle size.

The materials usable as the fine particle filler of the resin layer 6" include silica, potassium titanate, barium titanate or the like as well as the titanium oxide. The volume average particle size of the filler is preferably 1.0–20.0 microns.

The amount of applied resin layer 6" to the metal cylindrical base member 6' is preferably 2–8 g/m$^2$.

In the embodiments of FIGS. 4 and 5, the resin coating layer 7 contains graphite fine particles and carbon black fine particles (carbon black is contributable to leak the overcharge of the toner 4). It was also effective to contain graphite particles only. The volume average particle size of the graphite particles was preferably 0.5–15 microns, and that of the graphite particles was preferably 5–300 microns. Since the graphite particles also function as a solid lubricant, the average particle size is preferably larger than the carbon black particles.

The ratio of the resin to graphite particles plus carbon black in the outer layer 7 is preferably 1/1–3/1 by weight.

The amount of resin layer 7 was 8.0 mg/m$^2$. The preferable range is 4–12 mg/$^2$.

The resin binder used in the foregoing example was phenol, but other usable resins include epoxy resin, melamine resin, polyamide resin, silicone resin, polytetrafluoroethylene resin, polyvinylchloride resin, polycarbonate resin, polystyrene resin, polymetacrylate resin or the like.

The materials for the binder resin for the resin layer 6" include phenol resin, teflon, epoxy resin, melamine resin, urea resin and the like as well as the polyester resin shown in Table 6. The resin materials of the resin layer 6" and the resin coating 7 preferably satisfy the above described characteristics in connection with one another. When the resin layer 6" contains carbon black fine particles in addition to the fine particle filler, the volume average particle size of the carbon black fine particles is preferably 5–300 microns.

The ratio (weight) of the resin to fine particle filler plus carbon black was preferably 1/5–3/1.

The present invention is applicable to a developing apparatus using a one component non-magnetic developer. In such a case, the magnet 5 is not necessary in FIGS. 1–3.

According to the present invention, the ghost image is effectively prevented, and therefore, it is particularly effective for a developing apparatus using one component developer containing fine particle toner having an average particle size of 4–9 microns.

When an electrostatic latent image is developed using developer particles triboelectrically charged by the developing sleeve (roller) surface, the minimum clearance between the developing sleeve and the latent image bearing member in the developing zone is preferably 50–500 microns.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus for developing an electrostatic latent image, comprising:

a movable developer carrying member for carrying one component developer to a developing zone where said developer carrying member is opposed to a latent image bearing member for carrying the electrostatic latent image, said developer carrying member being effective to triboelectrically charge the developer to a polarity for developing the latent image;

a regulating member for regulating a thickness of a layer of the developer to be carried to the developing zone; and a voltage source for applying a developing bias voltage to said developer carrying member;

wherein said developer carrying member comprises a base member having a surface sandblasted to have an average surface roughness Ra of 1.0–3.0 microns, and an outer layer thereon in which fine graphite particles are dispersed in a binder resin material, and wherein the outer layer has an average surface roughness Ra of 0.8–2.5 microns.

2. An apparatus according to claim 1, wherein the binder resin of said outer layer contains fine carbon black particles dispersed therein.

3. An apparatus according to claim 2, wherein 4–12 g of said outer layer is applied on said base member per unit area (m$^2$).

4. An apparatus according to claim 2, wherein the average pit-to-pit or projection-to-projection spacing Sm on a surface of said outer layer is 30–70 microns.

5. An apparatus according to any one of claims 1–4, wherein said base member is of a metal roller sandblasted with irregular particles.

6. An apparatus according to any one of claims 1–4, wherein said voltage source applies an oscillating bias voltage to said developer carrying member.

7. An apparatus according to claim 6, wherein said regulating member regulates the thickness so that the thickness is smaller in the developing zone than a clearance between said developer carrying member and the image bearing member.

8. A developing roller for triboelectrically charging a one component developer to a polarity for developing an electrostatic latent image and for supplying the developer to an electrostatic latent image bearing member, comprising:

a base roller having a sandblasted surface having a surface roughness Ra of 1.0–3.0 microns; and an outer layer on said base roller comprising fine graphite particles dispersed in a resin binder, wherein said outer layer has an average surface roughness (Ra) of 0.8–2.5 microns.

9. A roller according to claim 8, wherein the binder resin of said outer layer contains fine carbon black particles dispersed therein.

10. A roller according to claim 9, wherein 4–12 g of said outer layer is applied on said base roller per unit area (m$^2$).

11. A roller according to claim 10, wherein an average pit-to-pit or projection-to-projection spacing Sm on a surface of said outer layer is 30–70 microns.

12. A roller according to any one of claims 8–11, wherein said base roller is of a metal roller sandblasted with irregular particles.

13. A developing apparatus for developing an electrostatic latent image, comprising:

a movable developer carrying member for carrying one component developer to a developing zone where said developer carrying member is opposed to a latent image bearing member for carrying the electrostatic latent image, said developer carrying member being effective to triboelectrically charge the developer to a polarity for developing the latent image; and a regulating member for regulating a thickness of a developer to be carried to the developing zone;

wherein said developer carrying member comprises a metal base member, an intermediate layer thereon having fine particles dispersed in a first binder resin and an outer layer having fine graphite particles dispersed in a second binder resin, and wherein an average particle size of the fine particles in said first binder resin is larger than that of the graphite particles in the second binder resin, and an average surface roughness Ra of the outer layer is 1.0–3.0 microns.

14. An apparatus according to claim 13, wherein said first binder resin fine carbon particles are dispersed.

15. An apparatus according to claim 13, wherein said second binder resin comprises fine carbon black particles dispersed therein.

16. An apparatus according to claim 14, wherein in said second binder resin, fine carbon black particles are further dispersed.

17. An apparatus according to any one of claims 13–16, wherein said first binder resin exhibits a stronger bonding strength to a metal constituting said base member than said second binder resin.

18. An apparatus according to claim 17, wherein said voltage source applies an oscillating bias voltage to said developer carrying member.

19. An apparatus according to claim 18, wherein said regulating member regulates the thickness so that the thickness is smaller in the developing zone than a clearance between said developer carrying member and the image bearing member.

20. A developing roller for triboelectrically charging a one component developer to a polarity for developing an electrostatic latent image and for supplying the developer to an electrostatic latent image bearing member, comprising:

a metal base roller;

an intermediate layer on said roller comprising fine particles dispersed in a first binder resin; and an outer layer on said intermediate layer comprising fine graphite particles in said second binder resin;

wherein an average particle size of the fine particles in said first binder resin is larger than that of the graphite particles in the second binder resin, and an average surface roughness Ra of the outer layer is 1.0–3.0 microns.

21. A roller according to claim 20, wherein in said first binder resin fine carbon particles and other fine particles having a larger average particle size are dispersed.

22. A roller according to claim 20, wherein said second binder resin comprises fine carbon black particles dispersed therein.

23. A roller according to claim 21, wherein in said second binder resin, fine carbon black particles are further dispersed.

24. A roller according to any one of claims 20–23, wherein said first binder resin exhibits a stronger bonding strength to a metal constituting said base member than said second binder resin.

25. An apparatus according to claim 21, wherein an average particle size of the graphite particles is larger than that of the black particles.

26. An apparatus according to claim 9, wherein an average particle size of the graphite particles is larger than that of the black particles.

27. An apparatus according to claim 13, wherein carbon black particles having an average particle size smaller than those of the fine particles and the graphite particles are dispersed in the first binder resin and second binder resin.

28. An apparatus according to claim 13, wherein a hardness of the second binder resin is greater than a hardness of the first binder resin.

29. An apparatus according to claim 20, wherein carbon black particles having an average particle size smaller than those of the fine particles and the graphite particles are dispersed in the first binder resin and second binder resin.

30. An apparatus according to claim 20, wherein a hardness of the second binder resin is greater than a hardness of the first binder resin.

31. A developing apparatus for developing an electrostatic latent image, comprising:

a movable developer carrying member for carrying one component developer to a developing zone where said developer carrying member is opposed to a latent image bearing member for carrying the electrostatic latent image, said developer carrying member being effective to triboelectrically charge the developer to a polarity for developing the latent image;

a regulating member for regulating a thickness of a layer of the developer to be carried to the developing zone; and a voltage source for applying a developing bias voltage to said developer carrying member;

wherein said developer carrying member comprises a base member having a surface sandblasted to have an average surface roughness Ra of 1.0–3.0 microns, and an outer layer thereon in which fine graphite particles are dispersed in a binder resin material, wherein the binder resin of said outer layer contains fine carbon black particles dispersed therein, wherein 4–12 g of said outer layer is applied on said base member per unit area ($m^2$), and wherein the outer layer has an average surface roughness Ra of 0.8–2.5 microns.

32. An apparatus according to claim 31, wherein the average pit-to-pit or projection-to-projection spacing Sm on a surface of said outer layer is 30–70 microns.

33. An apparatus according to claim 31, or 32, wherein said voltage source applies an oscillating bias voltage to said developer carrying member.

34. An apparatus according to claim 33, wherein said regulating member regulates the thickness so that the thickness is smaller in the developing zone than a clearance between said developer carrying member and the image bearing member.

35. An apparatus according to claim 31 or 32, wherein an average particle size of the graphite particles is larger than that of the black particles.

36. A developing roller for triboelectrically charging a one component developer to a polarity for developing an electrostatic latent image and for supplying the developer to an electrostatic latent image bearing member, comprising:

a base roller having a sandblasted surface having a surface roughness Ra of 1.0–3.0 microns; and an outer layer on said base roller comprising fine graphite particles dispersed in a resin binder, wherein said outer layer has an average surface roughness Ra of 0.8–2.5 microns, wherein the binder resin of said outer layer contains fine carbon black particles dispersed therein, and wherein 4–12 g of said outer layer is applied on said base roller per unit area ($m^2$).

37. A roller according to claim 36, wherein an average pit-to-pit or projection-to-projection spacing Sm on a surface of said outer layer is 30–70 microns.

38. A roller according to claim 36 or 37, wherein an average particle size of the graphite particles is larger than that of the black particles.

* * * * *

UNITED STATES PATENT AND TRADEMARK OFFICE

CERTIFICATE OF CORRECTION

PATENT NO. :5,286,917 Page 1 of 2

DATED :February 15, 1994

INVENTOR(S) :UNNO ET AL.

It is certified that error appears in the above-indentified patent and that said Letters Patent is hereby corrected as shown below: On the title page:

AT [56] References Cited

Foreign Patent Documents, change "01-05181 4/1990 Japan" to --2-0105181 4/1990 Japan-- change "01-09072 4/1990 Japan" to --2-0109072 4/1990 Japan--.

Column 1

Line 12, change "coping" to --copying--.

Column 3

Line 56, change "particularly" to --particularly,--.

Column 4

Line 64, change "when" to --by--.
Line 65, change "by" to --when--; and delete "becoming".

Column 5

Line 6, change "weight" to --weight,--.
Line 10, change "affect" to --effect--.

UNITED STATES PATENT AND TRADEMARK OFFICE

CERTIFICATE OF CORRECTION

PATENT NO. :5,286,917

DATED :February 15, 1994

INVENTOR(S) :UNNO ET AL.

It is certified that error appears in the above-indentified patent and that said Letters Patent is hereby corrected as shown below:

Column 6

Line 20, delete "is".

Column 14

Line 56, change "claim 31," to --claim 31--.

Signed and Sealed this

Sixth Day of September, 1994

*Attest:*

Bruce Lehman

BRUCE LEHMAN

*Attesting Officer*

*Commissioner of Patents and Trademarks*